US009504307B1

(12) United States Patent
Burnett et al.

(10) Patent No.: US 9,504,307 B1
(45) Date of Patent: Nov. 29, 2016

(54) ARTICULATING RESISTIVE CONFORMABLE SPINE

(71) Applicant: The United States of America as represented by the Secretary of the Air Force, Washington, DC (US)

(72) Inventors: Gregory M Burnett, Dayton, OH (US); Peter Voland, Fairborn, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 200 days.

(21) Appl. No.: 14/499,285

(22) Filed: Sep. 29, 2014

(51) Int. Cl.
*A45F 3/08* (2006.01)
*A45F 5/00* (2006.01)
*A45F 3/10* (2006.01)
*A45F 3/04* (2006.01)

(52) U.S. Cl.
CPC .. *A45F 3/10* (2013.01); *A45F 3/04* (2013.01); *A45F 3/047* (2013.01); *A45F 3/08* (2013.01)

(58) Field of Classification Search
CPC ..... A45F 3/08; A45F 3/04; A45F 3/047; A45F 5/00; A45F 3/10; A41D 13/0531; A61F 5/024
USPC ..... 224/634, 261, 262, 271; 602/3
See application file for complete search history.

(56) References Cited

U.S. PATENT DOCUMENTS 1,316,915 A * 9/1919 Meyer et al. ..... A61F 5/028 602/19
4,771,767 A * 9/1988 Steffee ..... A61B 17/7002 606/256
4,911,346 A * 3/1990 Shallman ..... A45F 3/08 224/153
5,328,447 A * 7/1994 Kapounek ..... A61F 5/055 128/846
5,375,823 A * 12/1994 Navas ..... A61B 17/7005 267/153
5,540,688 A * 7/1996 Navas ..... A61B 17/7005 606/266
6,296,644 B1 * 10/2001 Saurat ..... A61B 17/7013 606/256
8,353,434 B2 * 1/2013 Clayton, III ..... A45F 3/10 224/272
9,198,696 B1 * 12/2015 Bannigan ..... A61B 17/7052
2003/0050581 A1 * 3/2003 Berns ..... A41D 13/0531 602/3
2010/0088799 A1 4/2010 Carter
2010/0263111 A1 * 10/2010 Leatt ..... A41D 13/0512 2/467
2011/0120295 A1 5/2011 Carter
2014/0224849 A1 * 8/2014 Hiemenz ..... A45F 3/04 224/271
2014/0245529 A1 * 9/2014 Beckman ..... A41D 13/0531 2/468

FOREIGN PATENT DOCUMENTS

DE 4142279 A1 * 11/1992 ..... A41D 13/0531
DE 4228423 C1 * 9/1993 ..... A41D 13/0531
EP 2583572 A2 * 4/2013 ..... A41D 13/0531

* cited by examiner

*Primary Examiner* — Justin Larson
*Assistant Examiner* — Lester L Vanterpool
(74) *Attorney, Agent, or Firm* — AFMCLO/JAZ; Jason Sopko

(57) ABSTRACT

A flexible load bearing system includes a plurality of vertebrae. Each vertebra has a first portion, a second portion, and a socket formed in it. A plurality of links each has a ball at a first end and at a second end. At least one of the plurality of balls is disposed in one of the plurality of sockets, thus forming a column. A tension mechanism is mated to the first portion and to the second portion and configured to pull or push the first portion and the second portion together or apart, respectively.

7 Claims, 4 Drawing Sheets

ARTICULATING RESISTIVE CONFORMABLE SPINE

RIGHTS OF THE GOVERNMENT

The invention described herein may be manufactured and used by or for the Government of the United States for all governmental purposes without the payment of any royalty.

FIELD OF THE INVENTION

The present invention relates generally to load bearing personal equipment and, more particularly, to embodiments having a plurality of adjustable and repositionable support elements.

BACKGROUND OF THE INVENTION

Traditional Load Bearing Equipment (LBE) systems use rigid pieces of material to transfer loads from the upper shoulders and back to the hips. Some embodiments of combat load distribution systems utilize an integrated rigid spine that is affixed to the tactical vest or belt. Unfortunately, these solid components limit the range of motion of the wearer. As a result, the wearer's agility is affected. Particularly in a military or law enforcement environment, dynamic flexibility (flection/extension, lateral bending, and rotation) is a critical element that can enhance survivability. For example, quickly changing from standing to prone postures to take cover from incoming threats, jumping in and out of vehicles, and navigating through confined spaces are all important maneuvers in a dynamic environment.

Prior art systems greatly lose load bearing effectiveness when the wearer is not in a standing position. For example, when an operator must maneuver in a crouched posture through an area with low ceilings, the beneficial load distribution forces are offset by the normal force the LBE system provides. In the case of existing systems where flection occurs at the hip, the effectiveness of the system is further reduced and more burden is carried by the operator higher up the back (resulting in rapid fatigue).

Additionally, the rigid form of prior art LBE inhibits the spine's natural bending and rotation, limiting extension and flection at the hips. This can create snag hazards between the system and upper back when crouching forward. Moreover, the restriction in movement may prevent the operator's ability to navigate in close quarters.

Therefore, a need exists in the art for load distributing equipment that effectively transfers weight to the user's hips while providing improved articulation and freedom of motion.

SUMMARY OF THE INVENTION

The present invention overcomes the foregoing problems and other shortcomings, drawbacks, and challenges of supporting a load while maintaining user mobility and flexibility. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a flexible load bearing system is provided. The system includes a plurality of vertebrae. Each vertebra has a first portion, a second portion, and a socket formed in it. A plurality of links each has a ball at a first end and at a second end. At least one of the plurality of balls is disposed in one of the plurality of sockets, thus forming a column. A tension mechanism is mated to the first portion and to the second portion and configured to pull or push the first portion and the second portion together or apart, respectively.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
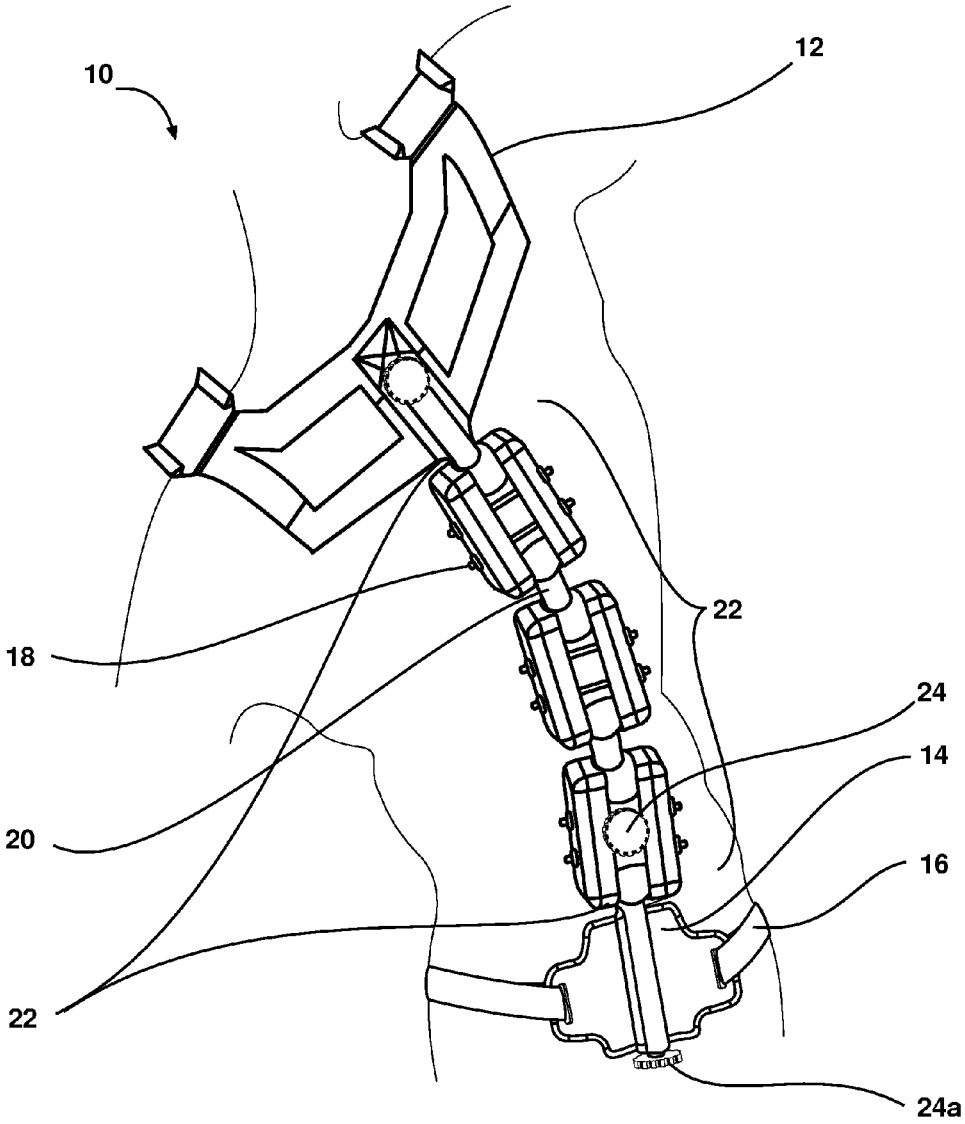
FIG. 1 is a perspective view of an embodiment of the disclosed invention.

FIG. 1 illustrates an embodiment of the disclosed support system 10. The first end of the system 10 includes a yoke 12 configured to mount over the shoulders of a user. The second end of the system 10 includes a mounting plate 14 adjustably coupled to a belt 16. In some embodiments, the yoke 12 is not configured to bear down upon the user's shoulders. Rather, some embodiments use the yoke 12 to retain the system 10 against the back of a user while ensuring that the majority of weight is borne by mounting plate 14 and belt 16. A Plurality of vertebrae 18 are disposed between the yoke 12 and the mounting plate 14. These vertebrae 18 are adjustably mated to each other by way of cooperating links 20. The interconnected vertebrae 18 and links 20 form an adjustable load bearing column 22. The column 22 may be configured to closely match the natural contours of the user, and to mimic the human spine's geometry and flexibility.

The vertebrae 18 and links 20 are joined in a frictional yet adjustable engagement with each other. The amount of frictional engagement may vary as a function of the weight to be supported by the system 10. The column 22 will then support most or all of the weight applied to the system 10 (rucksack, radio equipment, or the like). A user may then move his body to overcome the frictional forces supporting the column 22, while still allowing the system 10 to support a substantial portion of the load. For example, when mounted to a user standing in an upright position, the system 10 is substantially rigid and most of the load weight is transferred to the user's hips through the mounting plate 14 and belt 16. If the user bends to touch his toes, he must exert sufficient effort to overcome the frictional forces between the vertebrae 18 and links 20. Upon halting the motion of his torso, a significant portion of the load is then supported by the stiction forces established by the vertebrae 18 and links 20 of the column 22, and the mounting plate 14.

Some embodiments may use one or more tension knobs 24 to adjust the amount of frictional engagement between the vertebrae 18 and links 20. In some embodiments, each vertebra 18 has a tension knob 24 that may be used to adjust the frictional engagement of a given vertebra 18. Other embodiments use a communal tension knob 24*a* and cooperating mechanisms (as will be explained in detail below), to adjust the frictional engagement of all vertebrae 18 simultaneously. Some embodiments may allow for simultaneous localized adjustment with tension knobs 24 and global adjustment via communal tension knob 24*a*. By way of example, a tension knob 24 may be used to adjust the frictional engagement locally in the upper back, while the communal tension knob 24*a* may thereafter be employed to further stiffen the entire column 22 by an additional amount.

Figure 2:
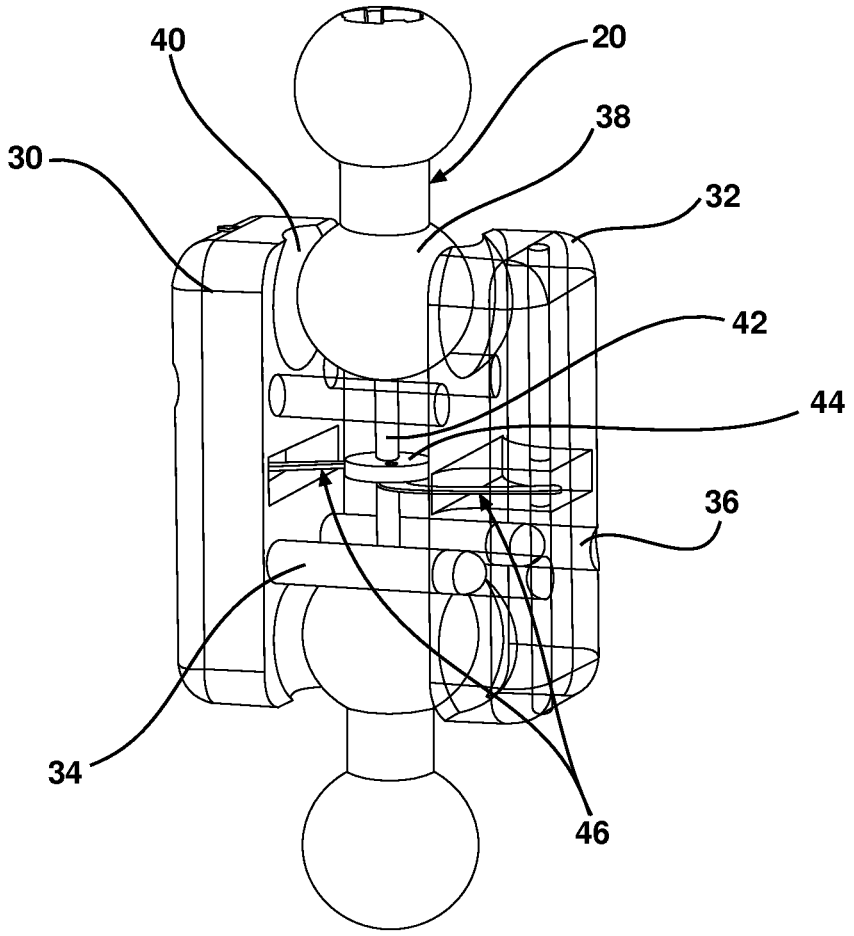
FIG. 2 is a partially exploded view according to an embodiment of the disclosed invention.

Turning attention to FIG. 2, an embodiment of a vertebra 18 and link 20 pair is shown. The vertebra 18 includes a first portion 30 and a second portion 32. The first portion 30 and second portion 32 are maintained in a cooperating relationship by way of one or more guide pins 34 disposed in one or more guide bores 36. As will be recognized by one of ordinary skill in the art, a variety of guides may be effective to maintain the first portion 30 and second portion 32 in an appropriate relationship. Guides resulting from nesting the first portion 30 and second portion 32, using springs or other resilient material to join the first portion 30 and second portion 32, or other physical constraints may produce acceptable results.

The link 20 includes a ball 38 disposed within a socket 40 formed in the first portion 30 and second portion 32. It should be noted that various modifications to the ball 38 will be discussed herein, and such modifications may result in a deviation from a pure ball or spherical shape. Nonetheless, "ball" as used herein, shall include socket-receiving geometries including those with projections, rebates, textures, or irregular surface shapes. A tension rod 42 passes through the links 20 and is mated to a tension cam 44 disposed in one or more vertebrae 18. One or more tension arms are joined between the first segment 30 or second segment 32 and the tension cam 44. In use, rotation of the tension knob 24 (FIG. 1), causes a corresponding rotation of the tension rod 42. The tension rod 42 and cooperating tension cam 44, in cooperation with the tension arms 46 selectively pull the first portion 30 and second portion 32 together. Reversing the rotation of the tension rod 42 may drive the first portion 30 and second portion 32 apart. In the alternative, the first portion 30 and second portion 32 may be biased either together or apart. For example, if the first portion 30 and second portion 32 are spring biased apart, actuation of the tension arms 46 override the spring bias, thus pulling the first portion 30 and second portion 32 together. In the absence of actuation by the tension arms 46, the first portion 30 and second portion 32 are driven apart by spring bias. Opposite bias, wherein the first portion 30 and second portion 32 are biased toward each other, may be employed. As will be recognized by one of skill in the art, springs may be replaced with resilient materials, elastically deformed plastic tabs, or the like. In various embodiments, the movement of the first portion 30 and the second portion 32, adjusts the frictional engagement between the socket 40 and ball 38. Some embodiments may employ texturing on the ball 38 or socket 40 or the ball and socket may be constructed of differing materials to yield various coefficients of friction.

It should be noted that various means for adding mechanical advantage to the system 10 may be employed. For example, the tension knob 24 or communal tension knob 24*a* may include gearing so that additional frictional engagement may be applied for a given torque applied to the tension knob 24 or 24*a* (as shown in FIG. 1). In the alternative, the mechanical advantage may be contained in the vertebra 18. For example, gearing, lever arms, eccentric surfaces, and the like may be employed to increase clamping force. Moreover, some embodiments may include one or more additional tension knobs 24 that may provide additional frictional engagement to one or more vertebra 18. For example a first tension knob 24 may adjust the frictional engagement of vertebrae 18 near the upper back of a user, and a second tension knob 24 may independently adjust the frictional engagement near the lower back of a user. Further still, a communal tension knob 24*a* may collectively adjust the tension of all vertebrae 18 in the system 10 (this is possible because the tension rod 42 may be configured to pass through every link 20 and vertebra 18 of the system 10), while additional tension knobs 24 may fine tune the frictional engagement of individual vertebra 18 (either loosening or tightening, as desired by a user).

Figure 3:
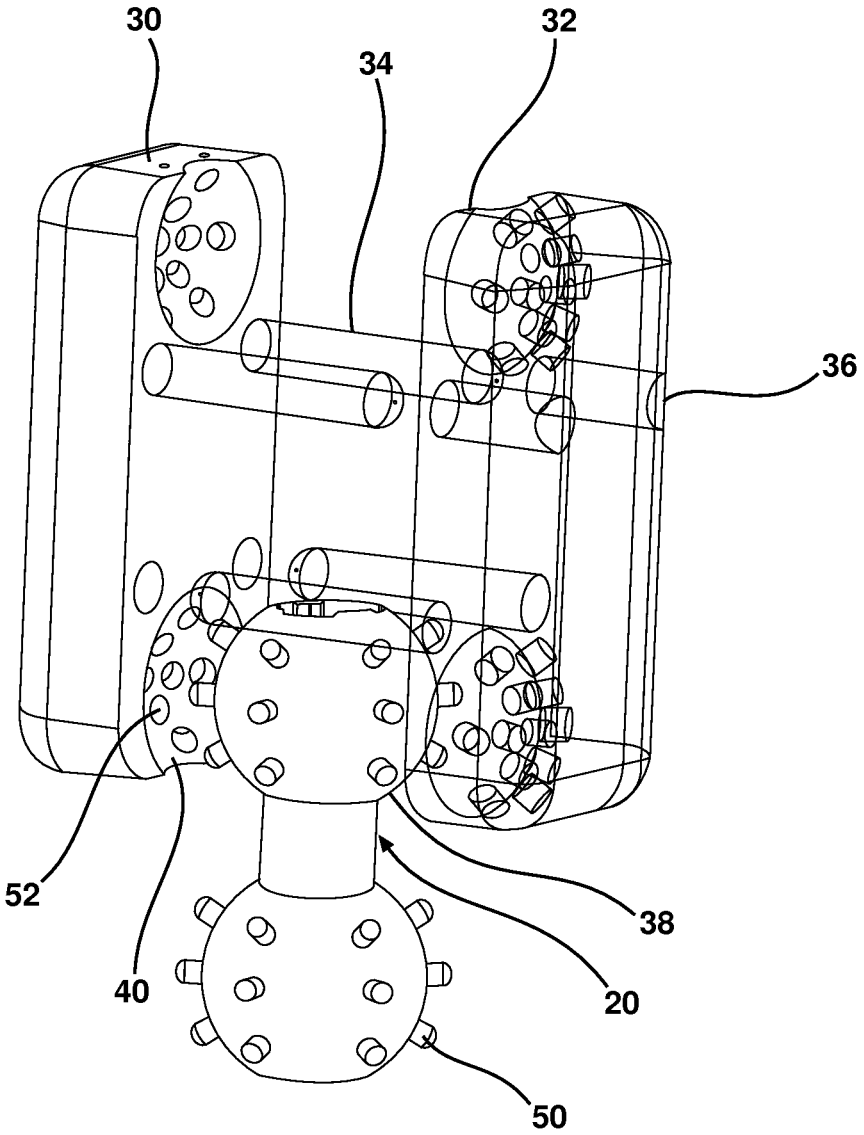
FIG. 3 is a partially exploded view having a positive locking mechanism in accordance with an embodiment of the disclosed invention.

Turning attention to FIG. 3, one or more studs 50 is disposed on the surface of the ball 38, and a plurality of pockets 52 are disposed in the surface of the socket 40. This configuration enables a plurality of positive locking positions to be selected between the link 20 and vertebra 18. In this embodiment, a positive and discrete locking position is used in lieu of the frictional engagement as shown in FIG. 2. As a result, the ball 38 may be selectively disposed in one of a plurality of positions with respect to the socket 40. In some embodiments, a greater number of pockets 52 than studs 50 may be used. Embodiments using the studs 50 and pockets 52 may be employed in only certain portions of the system 10 to provide ridged locking action, while other sections of the system 10 may use a frictional engagement (as described in FIG. 2). It should be noted that a variety of cooperating positive locking surfaces may be used, to include ridges, dimples, splines, texturing, and the like.

Figure 4:
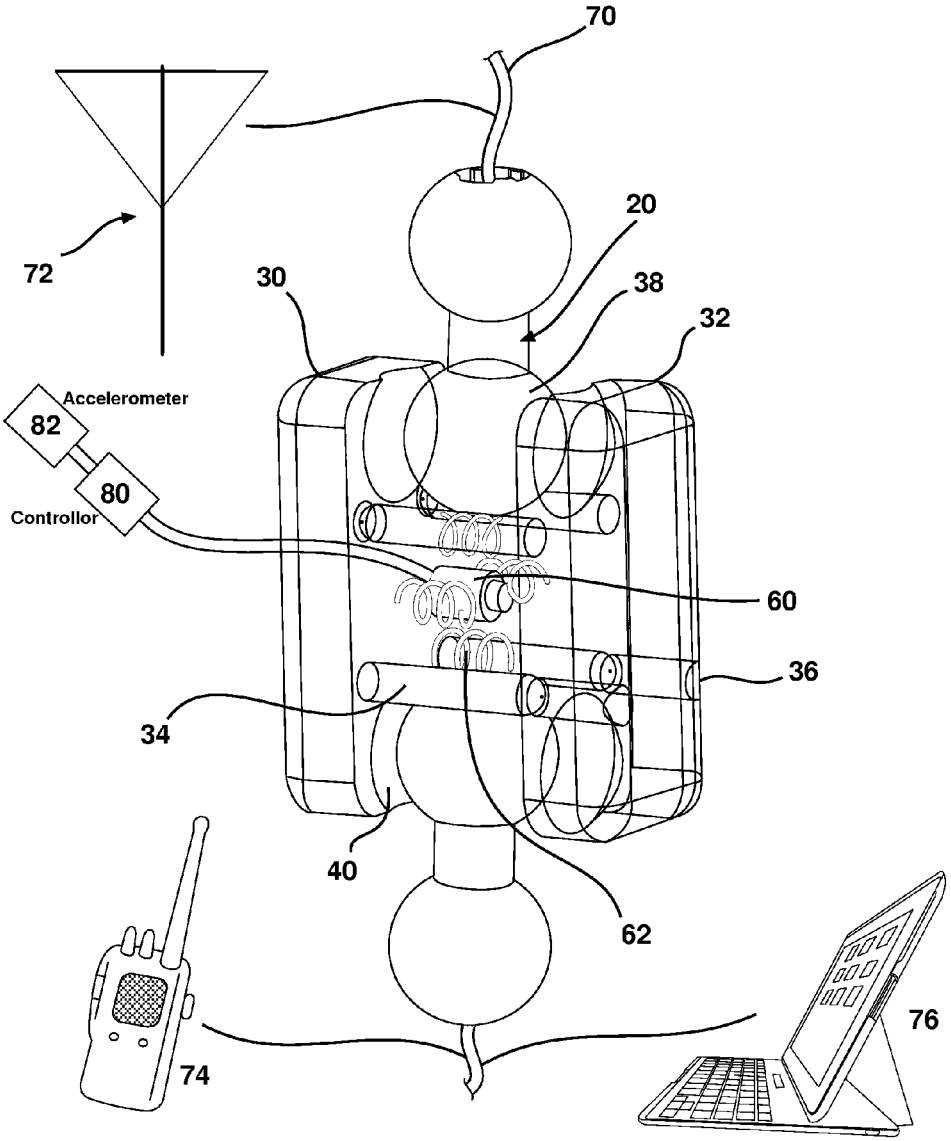
FIG. 4 is a partially exploded view of a solenoid actuated embodiment of the disclosed invention.

FIG. 4 shows yet another embodiment of a system 10 using a solenoid 60 to impart a frictional engagement between the ball 38 and socket 40. In one embodiment, springs 62 are configured to maintain a frictional engagement between the first portion 30 and second portion 32 of the socket 40 and ball 38. When the solenoid 60 is energized, it drives the first portion 30 and second portion 32 apart, thus releasing the frictional engagement and allowing adjustment. In some embodiments, the solenoid 60 is configured to provide an adjustable degree of frictional engagement. For example, a user supporting a load with the system 10 may overcome the frictional forces of the system 10 by moving his torso. In this way, a user may stand for prolonged periods of time while the system 10 transfers a portion of the load off of his shoulders and spine, yet may move his body and the system 10 as needed to tend to dynamic activities. This degree of adjustable frictional engagement may also be used with the mechanism as shown in FIG. 2. In other embodiments, the spring 62 biases the first portion 30 and second portion 32 apart, and the solenoid 60 draws the first portion and second portion together when energized. The solenoid 60 actuated embodiments may include the rigid locking studs 50 and pockets 52 as shown in FIG. 3 (or other positive locking geometries).

Some embodiments of the system 10 may include a controller 80 electrically coupled the solenoids 60 and to one or more accelerometers 82. The controller 80 receives motion and orientation data from the accelerometer 82 to determine the current position of a user. When the user begins to move his body, the controller 80 determines which of the solenoids should be energized, to allow the user to easily reposition the column 22. When the user halts his motion, the controller receives data from the accelerometer 82 and de-energizes the solenoids 60 (thus reestablishing a frictional relationship between within the column 22). In some embodiments the controller may energize the solenoids 60 in a variable fashion, to create a variable degree of frictional engagement. In some embodiments, a user must move his body to exert a force against the column 22 for a predetermined amount of time before the controller 80 will energize the solenoids 60. Likewise, a delay may be implemented between the time a user stops his motion, and when the controller 80 de-energizes the solenoids 60. By use of the accelerometer 82 and controller 80, a user may reposition the column 22 without having to strain to overcome the relatively high stiction forces that are necessary to support heavy loads.

Some embodiments of the system 10, such as those shown in FIGS. 1-4 may be fabricated as a stand-alone unit, while other embodiments may be incorporated into a tactical vest or rucksack chassis. Additionally, the series of links 20 and vertebrae 18 forming the column 22, may provide a flexible conduit for the passage of a cable 70. This allows a variety of equipment, such as an antenna 72, radio 74, data terminal 76, or the like to be interconnected via the system 10. Further, the kinetic energy applied by a user to the column 22 may be converted to electricity via piezoelectric strips or micro generators.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A flexible load bearing system, the system comprising:

a plurality of vertebrae each having a first portion, a second portion, and a socket formed therein;

a plurality of links each having a ball at a first end and at a second end, wherein at least one of the plurality of balls is disposed in one of the plurality of sockets, thus forming a column;

a tension mechanism mated to the first portion and to the second portion and configured to pull or push the first portion and the second portion together or apart, respectively;

a yoke mated to a first end of the column, and a mounting plate mated to a second end of the column; and wherein the tension mechanism includes a spring configured to bias the first portion and the second portion together, and further including a solenoid configured to opposed the spring bias when energized.

2. The apparatus of claim 1, wherein the tension mechanism includes a spring configured to bias the first portion and the second portion apart, and further including a solenoid configured to oppose the spring bias when energized.

3. The apparatus of claim 2, further including a controller electrically connected to the solenoid and to an accelerometer, wherein the controller selectively energizes and de-energizes the solenoid in response to a data transmitted by the accelerometer to the controller.

4. The mechanism of claim 1, further including a plurality of studs extending from at least one of the plurality of balls, and a plurality of pockets disposed in at least one of the plurality of sockets.

5. The apparatus of claim 4, further including a controller electrically connected to the solenoid and to an accelerometer, wherein the controller selectively energizes and de-energizes the solenoid in response to a data transmitted by the accelerometer to the controller.

6. The mechanism of claim 1, further including a tension cam and a tension arm mated between one of the first portion or the second portion and the tension cam, wherein rotation of the tension cam and cooperating tension arm pushes or pulls the first portion in relation to the second portion.

7. The mechanism of claim 6, further including a tension knob operatively mated to the tension cam and configured to rotate the tension cam upon rotation of the tension knob.

* * * * *